US006932586B2

(12) United States Patent
Furusho et al.

(10) Patent No.: US 6,932,586 B2
(45) Date of Patent: Aug. 23, 2005

(54) SCROLL-TYPE COMPRESSOR

(75) Inventors: Kazuhiro Furusho, Sakai (JP); Katsumi Kato, Sakai (JP); Takahiro Ohno, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/495,270

(22) PCT Filed: Apr. 23, 2003

(86) PCT No.: PCT/JP03/05221

§ 371 (c)(1),
(2), (4) Date: May 10, 2004

(87) PCT Pub. No.: WO03/102421

PCT Pub. Date: Dec. 11, 2003

(65) Prior Publication Data

US 2004/0265159 A1 Dec. 30, 2004

(30) Foreign Application Priority Data

May 16, 2002 (JP) ..... 2002-140974

(51) Int. Cl.[7] ..... F04C 18/00

(52) U.S. Cl. ..... 418/55.5; 418/57; 418/55.4; 418/55.6

(58) Field of Search ..... 418/55.5, 57, 55.4, 418/55.6

(56) References Cited

U.S. PATENT DOCUMENTS 4,557,675 A * 12/1985 Murayama et al. ..... 418/55.5
5,133,651 A 7/1992 Onoda et al.
6,196,817 B1 * 3/2001 Tsumagari et al. ..... 418/55.6
6,533,561 B1 * 3/2003 Furusho et al. ..... 418/55.5
6,533,562 B1 * 3/2003 Sun ..... 418/55.6

FOREIGN PATENT DOCUMENTS

| | | | | |
|---|---|---|---|---|
| JP | 59-087291 A | | 5/1984 | |
| JP | 64-003285 A | | 1/1989 | |
| JP | 04-4477 B2 | | 1/1992 | |
| JP | 07224775 A | * | 8/1995 | ..... F04C/18/02 |
| JP | 09-228968 A | | 9/1997 | |
| JP | 10-184567 A | | 7/1998 | |
| JP | 2003254263 A | * | 9/2003 | ..... F04C/18/02 |

* cited by examiner

*Primary Examiner*—Theresa Trieu
(74) *Attorney, Agent, or Firm*—Shinjyu Global LP Counselors, LLP.

(57) ABSTRACT

An adjusting mechanism (56) is provided to produce an anti-overturning moment to reduce an overturning moment acting on an orbiting scroll (26) during its revolution in a revolving-angle area in which the overturning moment becomes a certain value or more. Accordingly, revolution movement of the orbiting scroll (26) can be made stable by changing a pressing force of the orbiting scroll (26) against the fixed scroll (22) according to fluctuation of the overturning moment due to the revolution of the orbiting scroll (26), thereby improving the compression efficiency of a scroll-type compressor (1).

18 Claims, 7 Drawing Sheets

(Prior Art)

SCROLL-TYPE COMPRESSOR

TECHNICAL FIELD

The present invention relates to a scroll-type compressor, and particularly to the scroll-type compressor including an adjusting mechanism to adjust a pressing force, in which an orbiting scroll is pressed against a fixed scroll with the pressing force to prevent the orbiting scroll from overturning.

BACKGROUND ART

Conventionally, a scroll-type compressor as an example of a compressor to compress a gas refrigerant in a refrigerating cycle has been used. The scroll-type compressor includes a fixed scroll and an orbiting scroll, which have involute wraps engaged with each other, in its casing. The fixed scroll is fixed to the casing and the orbiting scroll is coupled to an eccentric portion of a drive shaft (crank shaft). In the scroll-type compressor, the orbiting scroll just revolves orbitally to the fixed scroll without rotating on its own axis, thereby contracting a compression chamber formed between the wraps of both scrolls to compress a gas such as the refrigerant therein.

A certain compressor of this scroll-type compressor adopts a structure in which an orbiting scroll (OS) is pressed against a fixed scroll (FS) in the axis direction, as shown in FIG. 10. A purpose of this structure is to avoid a state occurring, where a refrigerant leaks and thereby an efficiency is reduced, due to inclination (overturn) of the orbiting scroll (OS) caused by so-called overturning moment that is produced by an axis-direction gas load Fz acting on the orbiting scroll (OS) by gas compression and a radius-direction load Fx which is a resultant force of gas force and centrifugal force.

It is known that the above-described axis-direction gas load Fz and radius-direction load Fx show their highest magnitudes almost at the same time, as shown in FIG. 11. Specifically, at a crank angle (revolution angle of the orbiting scroll (OS)) where an internal pressure of the compression chamber reaches about its highest pressure, these loads Fz, Fx become the highest and also the overturning moment M becomes the highest.

Problems to be Solved

Herein, it would be necessary that the magnitude of the above pressing force should be set based on the highest value of the overturning moment in order to prevent the orbiting scroll (OS) from overturning certainly during the operation of the compressor. However, just setting the pressing force at a certain magnitude that could prevent the orbiting scroll (OS) from overturning at the time the overturning moment shows its highest value would cause an overproduction of pressing force at a crank angle where the overturning moment is lower than its highest value, resulting in a lower efficiency due to some machine loss.

Meanwhile, another compressor of this scroll-type compressor adopts a structure in which refrigerating machine oil with high pressure is plied to a sliding face constituted of the fixed scroll (FS) and the orbiting scroll (OS), thereby the orbiting scroll (OS) is pressed back with a force Fo against the above pressing force. For example, Japanese Patent Laid-Open Publication No. 2001-214872 shows an adjusting structure to adjust the pressing force according to fluctuation of a compression ratio (or a pressure differential between high-level pressure and low-level pressure) based on operating conditions of the apparatus. However, this prior art compressor does not either perform adjusting a pressing-back force according to fluctuation of the above axis-direction gas load or the overturning moment during the orbital revolution of the orbiting scroll (OS). Namely, in the above compressor, the pressing-back force is generated or halted according merely to the magnitude of the compression ratio (or the high-low pressure differential), and the pressing-back force has constant strength regardless of its crank angle when it is generated. Accordingly, this compressor cannot cope with the fluctuation of the overturning moment and the like during the revolution of the orbiting scroll (OS) and thus it cannot make the orbital movement of the orbiting scroll (OS) stable sufficiently.

The present invention has been devised in view of these problems, and an object of the present invention is to make the revolution movement of the orbiting scroll stable by changing the pressing force of the orbiting scroll against the fixed scroll according to fluctuation of the axis-direction gas load or the overturning moment during the revolution of the orbiting scroll, thereby improving compression efficiency of the scroll-type compressor.

DISCLOSURE OF THE INVENTION

In the present invention, the above-described pressing force is made stable by producing a moment to reduce or offset the overturning moment, or by changing a pressing-back force of the orbiting scroll (26) according to the revolution angle of the orbiting scroll (26).

Firstly, in first through seventh aspects of the present invention, it is constituted such that an anti-overturning moment to reduce the overturning moment at a certain crank angle is produced.

According to the first aspect of the present invention, a scroll-type compressor is provided that comprises a fixed scroll (22) that is fixed in a casing (10), an orbiting scroll (26) that engages with the fixed scroll (22), pressing means (37*b*, 52) that presses the orbiting scroll (26) against the fixed scroll (22) in the axis direction, and an adjusting mechanism (56) that adjusts a pressing force of the orbiting scroll (26) against the fixed scroll (22).

Further, in the scroll-type compressor, the adjusting mechanism (56) is constituted such that an anti-overturning moment to decrease an overturning moment acting on the orbiting scroll (26) during its revolution is produced in a revolving-angle area of the orbiting scroll (26) in which the overturning moment becomes a predetermined value or a certain value or more.

According to the first aspect of the present invention, the anti-overturning moment acts on the orbiting scroll (26) that tends to be overturned in the revolving-angle area in which the overturning moment becomes great during the revolution of the orbiting scroll (26). This anti-overturning moment can reduce the overturning moment, and thus the orbiting scroll (26) can be prevented from overturning even in the above-described angle area and its stable revolution can be achieved.

Further, the second aspect of the present invention provides the scroll-type compressor of the first aspect, wherein the adjusting mechanism (56) is constituted such that the anti-overturning moment acts in substantially the opposite direction to the overturning moment in the revolving-angle area of the orbiting scroll (26) in which the overturning moment becomes the certain value or more.

According to the second aspect of the present invention, the anti-overturning acts in a direction in which the overturning moment is offset in the revolving-angle area in which the overturning moment becomes great. Thus, the orbiting scroll (26) can be further prevented from overturning and its stable revolution can be further achieved.

Further, the third aspect of the present invention provides the scroll-type compressor of the first or second aspects, wherein the adjusting mechanism (56) comprises an oil groove (55) that is formed at a sliding face constituted between the fixed scroll (22) and the orbiting scroll (26), and an oil-introduction passage (53) that introduces a high-pressure oil into the oil groove (55), and the oil groove (55) is constituted such that an acting point of a high pressure to the orbiting scroll (26) is offset from the center of the orbiting scroll (26) located in the above revolving-angle area.

According to the third aspect of the present invention, the acting point of pressing-back force by pressure of the high-pressure oil introduced into the oil groove (55) is offset from the center of the orbiting scroll (26), and thereby the above-described anti-overturning moment is produced. Accordingly, when the overturning moment becomes the certain value or more according to the revolution of the orbiting scroll (26), the anti-overturning moment produced by the pressure of the high-pressure oil can reduce the overturning moment. Thus, the revolution of the orbiting scroll (26) can be made stable. Further, in the revolving-angle area in which the overturning moment is less than the certain value, the strength of the above-described pressing force should be set at a proper value so that the orbiting scroll (26) could not be overturned in the opposite direction by the anti-overturning moment.

Further, in the fourth through seventh aspects of the present invention, shapes of the oil groove (55) are defined respectively. The fourth aspect of the present invention provides the scroll-type compressor of the third aspect, wherein the oil groove (55) is formed in a circumferential ring shape and formed at the fixed scroll (22) or the orbiting scroll (26) in such a manner that its center is offset from the center of the orbiting scroll (26) located in the above revolving-angle area.

Further, the fifth aspect of the present invention provides the scroll-type compressor of the third aspect, wherein the oil groove (55) is constituted such that an oil-pressure acting area at an acting side of the overturning moment is smaller than that at the opposite acting side of the overturning moment to the center of the orbiting scroll (26) located in the above revolving-angle area.

Further, the sixth aspect of the present invention provides the scroll-type compressor of the fifth aspect, wherein the oil groove (55) is formed in a circumferential ring shape with its center concentric to the orbiting scroll (26), and formed in such manner that a portion (62) thereof at the acting side of the overturning moment to the center of the orbiting scroll (26) located in the above revolving-angle area is disconnected.

Further, the seventh aspect of the present invention provides the scroll-type compressor of the fifth aspect, wherein the oil groove (55) is formed in a circumferential ring shape with its center concentric to the orbiting scroll (26), and comprises a widened portion (64) with an enlarged width at the opposite acting side of the overturning moment to the center of the orbiting scroll (26) located in the above revolving-angle area.

According to the inventions of the fourth thought seventh aspect, it is constituted such that the circumferential ring-shape oil groove (55) is offset from the center of the orbiting scroll (26) or there exists a difference of area between the acting side and the opposite acting side of the overturning moment to the center of the orbiting scroll (26). Thus, the high-pressure oil can produce the anti-overturning moment in the above-described revolving-angle area, thereby reducing the overturning moment.

Next, in the eighth through thirteenth aspect of the present invention, it is constituted such that the pressing-back force of the orbiting scroll (26) is reduced or cut off at a certain crank angle, respectively.

Specifically, the eighth aspect of the present invention provides, like the present invention defined in first aspect, the scroll-type compressor comprising a fixed scroll (22) that is fixed in a casing (10), an orbiting scroll (26) that engages with the fixed scroll (22), pressing means (37*b*, 52) that presses the orbiting scroll (26) against the fixed scroll (22) in the axis direction, and an adjusting mechanism (67) that adjusts a pressing force of the orbiting scroll (26) against the fixed scroll (22).

Further, in the scroll-type compressor, the adjusting mechanism (67) is constituted such that it produces a pressing-back force to press back the orbiting scroll (26) from the fixed scroll (22) against the pressing force, while it cuts off the pressing-back force in a revolving-angle area of the orbiting scroll (26) in which an overturning moment acting on the orbiting scroll (26) during its revolution due to gas compression becomes a predetermined value or a certain value or more.

According to the eighth aspect of the present invention, as the orbiting scroll (26) revolves to perform the function of gas compression, the overturning moment acting on the orbiting scroll (26) changes according to its revolution as shown in FIG. 11. And when the overturning moment becomes greater at the certain revolving-angle area, the pressing-back force by the adjusting mechanism (67) is cut off. Accordingly, it can be avoided that the resultant force by the axis-direction gas load, the pressing-back force, and the pressing force produced by the pressing means (37*b*, 52) becomes less than a minimum of necessary pressing force. Further, applying the pressing-back force to the orbiting scroll (26) all the time except the above angle area can prevent the pressing force from becoming too much. Thus, the orbiting scroll (26) can perform its stable revolution without any overturning or excess compressing.

Further, the ninth aspect of the present invention provides the scroll-type compressor of the eighth aspect, wherein the adjusting mechanism (67) comprises an oil groove (55) that is formed at a sliding face constituted between the fixed scroll (22) and the orbiting scroll (26), and an oil-introduction passage (53) that is capable of being connected to the oil groove (55) so as to introduce a high-pressure oil into the oil groove (55), and the oil groove (55) and the oil-introduction passage (53) are constituted such that their connection is cut off in the revolving-angle area of the orbiting scroll (26) in which the overturning moment acting on the orbiting scroll (26) due to gas compression becomes the certain value or more. For example, in the case where the oil groove (55) is formed at the fixed scroll (22) and the oil-introduction passage (53) is formed at the orbiting scroll (26), an opening end portion of the oil-introduction passage (53) orbitally rotates on the circumference having its radius that is equivalent to the revolving radius of the orbiting scroll (26), and therefore it should be constituted such that the oil-introduction passage (53) is not connected to the oil groove (55) only at part of its locus (position of the opening end portion when the orbiting scroll (26) is in the above-described revolving angle area), but connected at other parts of it.

According to the ninth aspect of the present invention, the pressing-back force against the pressing force of the orbiting scroll (26) to the fixed scroll (22) occurs at a state in which the oil-introduction passage (53) is connected to the oil groove (55), whereas the connection between the oil groove (55) and the oil-introduction passage (53) is cut off and thereby no pressing-back force occurs in the revolving-angle area in which the overturning moment acting on the orbiting scroll (26) due to gas compression becomes the certain value or more. Accordingly, the resultant force by the axis-direction gas load, the pressing-back force by the high-pressure oil, and the pressing force by the pressing means (37*b*, 52) can be made small in the area in which the overturning moment produced by the gas compression is small, whereas the resultant force by the axis-direction gas load and the pressing force by the pressing means (37*b*, 52) can be made great in the area in which the overturning moment is great. Thus, switching on and off the pressing-back force by the high-pressure oil according to the revolving-angle area of the orbiting scroll (26) can achieve stable revolution of the orbiting scroll (26).

The tenth aspect of the present invention defined provides, like the present inventions defined in the first and eighth aspect, the scroll-type compressor comprising a fixed scroll (22) that is fixed in a casing (10), an orbiting scroll (26) that engages with the fixed scroll (22), pressing means (37*b*, 52) that presses the orbiting scroll (26) against the fixed scroll (22) in the axis direction, and an adjusting mechanism (67) that adjusts a pressing force of the orbiting scroll (26) against the fixed scroll (22).

Further, in the scroll-type compressor, the adjusting mechanism (67) is constituted such that it produces a pressing-back force to press back the orbiting scroll (26) from the fixed scroll (22) against the pressing force, while it reduces the pressing-back force in a revolving-angle area of the orbiting scroll (26) in which an overturning moment acting on the orbiting scroll (26) during its revolution due to gas compression becomes a certain value or more.

According to the tenth aspect of the present invention, as the orbiting scroll (26) orbitally revolves to perform the function of gas compression, the overturning moment acting on the orbiting scroll (26) changes according to its revolution as shown in FIG. 11. And when the overturning moment becomes greater at the certain revolving-angle area, the pressing-back force by the adjusting mechanism (67) is reduced. Accordingly, it can be avoided that the resultant force by the axis-direction gas load, the pressing-back force, and the pressing force produced by the pressing means (37*b*, 52) becomes less than a minimum of necessary pressing force. Further, applying the pressing-back force to the orbiting scroll (26) all the time except the above angle area can prevent the pressing force from becoming too much. Thus, the orbiting scroll (26) can perform its stable revolution without any overturning or excess compressing.

Further, the eleventh aspect of the present invention provides the scroll-type compressor of the tenth aspect, wherein the adjusting mechanism (67) comprises an oil groove (55) that is formed at a sliding face constituted between the fixed scroll (22) and the orbiting scroll (26), and an oil-introduction passage (53) that is connected to the oil groove (55) so as to introduce a high-pressure oil into the oil groove (55), and the oil groove (55) and the oil-introduction passage (53) are constituted such that an area of their connection is reduced in the revolving-angle area of the orbiting scroll (26) in which the overturning moment acting on the orbiting scroll (26) due to gas compression becomes the certain value or more. For example, in the case in which the oil groove (55) is formed at the fixed scroll (22) and the oil-introduction passage (53) is formed at the orbiting scroll (26), an opening end portion of the oil-introduction passage (53) orbitally rotates on the circumference having its radius that is equivalent to the revolving radius of the orbiting scroll (26), and therefore it should be constituted such that a connection area between the oil-introduction passage (53) and the oil groove (55) is reduced only at part of its locus (position of the opening end portion when the orbiting scroll (26) is in the above-described revolving angle area).

According to the eleventh aspect of the present invention, the pressing-back force against the pressing force of the orbiting scroll (26) to the fixed scroll (22) occurs at a state in which the oil-introduction passage (53) is connected to the oil groove (55), whereas the connection area between the oil groove (55) and the oil-introduction passage (53) is reduced and thereby the pressing-back force is reduced in the revolving-angle area in which the overturning moment acting on the orbiting scroll (26) due to gas compression becomes the certain value or more. Accordingly, the resultant force by the axis-direction gas load, the pressing-back force by the high-pressure oil, and the pressing force by the pressing means (37*b*, 52) can be made small in the area in which the overturning moment produced by the gas compression is small, whereas the resultant force by the axis-direction gas load, the pressing-back force by the high-pressure oil, and the pressing force by the pressing means (37*b*, 52) can be made great by reducing the pressing-back force in the area in which the overturning moment is great. Thus, reducing the pressing-back force according to the revolving-angle area of the orbiting scroll (26) can achieve stable revolution of the orbiting scroll (26).

Further, the twelfth aspect of the aspect of the present invention provides the scroll-type compressor of the tenth aspect, wherein the adjusting mechanism (67) comprises an oil groove (55) that is formed at a sliding face constituted between the fixed scroll (22) and the orbiting scroll (26), and an oil-introduction passage (53) that is connected to the oil groove (55) so as to introduce a high-pressure oil into the oil groove (55), the oil groove (55) is formed at either one of the fixed scroll (22) and the orbiting scroll (26), and a low-pressure recess (71) that the oil groove (55) approaches in the revolving-angle area of the orbiting scroll (26) in which the overturning moment acting on the orbiting scroll (26) due to gas compression becomes the certain value or more is formed at the other one of the fixed scroll (22) and the orbiting scroll (26).

Further, the thirteenth aspect of the present invention provides the scroll-type compressor of the twelfth aspect, wherein the low-pressure recess (71) is constituted of a notch that is formed at the fixed scroll (22) or the orbiting scroll (26) so as to connect with a space having a lower pressure than the inside of said oil groove (55).

According to the present inventions defined in the twelfth and thirteenth aspects, the revolution of the orbiting scroll (26) makes the oil groove (55) and the low-pressure recess (71) move in such manner that they approach each other and then are away from each other during the operation of the scroll-type compressor. Herein, the oil groove (55) and the low-pressure recess (71) approach each other in the revolving-angle area in which the overturning moment acting on the orbiting scroll (26) due to gas compression is more than the certain value, and then it is capable that the high-pressure oil in the oil groove (55) can be released (leaked) to the low-pressure recess (71). Thus, the pressure of the oil groove (55) goes down and the pressing-back force is reduced. Accordingly, in the structure that the orbiting scroll (26) is normally balanced with the pressing force by pressing back it from the fixed scroll (22), the pressing-back force can be reduced only at the angle area in which the overturning moment becomes great, thereby achieving stable revolution of the orbiting scroll (26).

Effects of the Invention

According to the first aspect of the present invention, producing the anti-overturning moment in the revolving-angle area in which the overturning moment acting on the orbiting scroll (26) becomes the certain value or more reduces the overturning moment, and stable revolution of the orbiting scroll (26) becomes possible. Accordingly, it can prevent the orbiting scroll (26) from overturning without the leakage of the refrigerant when the overturning moment becomes great, and thus decease of the operation efficiency can be prevented.

Further, according to the second aspect of the present invention, the anti-overturning moment acts in a direction opposite to the overturning moment in the revolving-angle area in which the overturning moment becomes the certain value or more. Thus, the function of the anti-overturning moment to reduce the overturning moment can be performed efficiently. Accordingly, the revolution of the orbiting scroll (26) can be made further stable, and thus the decease of the operation efficiency can be further prevented certainly.

Further, according to the third aspect of the present invention, the oil groove (55) is formed at the sliding face constituted between the fixed scroll (22) and the orbiting scroll (26), the high-pressure oil is introduced into the oil groove (55), and the acting point of high pressure is offset from the center of the orbiting scroll (26). Thus, it can produce certainly the anti-overturning moment to reduce the overturning moment, thereby achieving further stable revolution of the orbiting scroll (26).

Further, according to the fourth aspect of the present invention, only offsetting the circumferential ring-shape oil groove (55) from the center of the orbiting scroll (26) can perform the above-described function, and thus the structure can be prevented from being complicated.

Further, according to the fifth aspect of the present invention, providing the difference in the area of the oil groove (55) between the acting side and the opposite acting side of the overturning moment to the center of the orbiting scroll (26) can produce certainly the anti-overturning moment to reduce the overturning moment.

Particularly, the structures, in which the portion (62) of the oil groove (55) at the acting side of the overturning moment to the center of the orbiting scroll (26) is disconnected according to the present invention defined in the sixth aspect, and the portion (64) of the oil groove (55) at the opposite acting side of the overturning moment to the center of the orbiting scroll (26) is widened according to the present invention defined in the seventh aspect, can reduce the overturning moment with a simple structure to make the movement of the orbiting scroll (26) stable, thereby improving the operation efficiency of the compressor.

According to the eighth aspect of the present invention, cutting off the pressing-back force to act against the pressing force for pressing the orbiting scroll (26) to the fixed scroll (22) in the revolving-angle area in which the overturning moment acting on the orbiting scroll (26) due to gas compression becomes the certain value or more can make the revolution of the orbiting scroll (26) stable without overturning and producing an excessive pressing force. Thus, the decease of the operation efficiency can be prevented like the inventions defined in the first through seventh aspects.

Further, according to the ninth aspect of the present invention, switching the connection state properly between the oil groove (55) formed at the sliding face of the orbiting scroll (26) and the fixed scroll (22) and the oil-introduction passage (53) introducing the high-pressure oil into the oil groove (55) can make it possible to stabilize the revolution of the orbiting scroll (26). For example, in the case in which the oil groove (55) is formed at the fixed scroll (22) and the oil-introduction passage (53) is formed at the orbiting scroll (26), making use of the opening end portion of the oil-introduction passage (53) rotating on the circumference having its radius that is equivalent to the revolving radius of the orbiting scroll (26) can provide easily the structure that the oil-introduction passage (53) is not connected to the oil groove (55) at part of its locus (position of the opening end portion when the orbiting scroll (26) is in the above-described revolving-angle area), but connected at other parts of its locus. And, also the structure can be prevented from being complicated.

Further, according to the tenth aspect of the present invention, reducing the pressing-back force to act against the pressing force for pressing the orbiting scroll (26) to the fixed scroll (22) in the revolving-angle area in which the overturning moment acting on the orbiting scroll (26) due to gas compression becomes the certain value or more can make the revolution of the orbiting scroll (26) stable without overturning and producing an excessive pressing force. Thus, the decease of the operation efficiency can be prevented.

Further, according to the eleventh aspect of the present invention, changing the connection state properly between the oil groove (55) formed at the sliding face of the orbiting scroll (26) and the fixed scroll (22) and the oil-introduction passage (53) introducing the high-pressure oil into the oil groove (55) can make it possible to certainly stabilize the revolution of the orbiting scroll (26). For example, in the case in which the oil groove (55) is formed at the fixed scroll (22) and the oil-introduction passage (53) is formed at the orbiting scroll (26), making use of the opening end portion of the oil-introduction passage (53) rotating on the circumference having its radius that is equivalent to the revolving radius of the orbiting scroll (26) can provide easily the structure that the oil-introduction passage (53) is connected to the oil groove (55) at part of its locus (position of the opening end portion when the orbiting scroll (26) is in the above-described revolving angle area) through a small connecting area. And, also the structure can be prevented from being complicated.

Further, according to the twelfth aspect of the present invention, releasing the high-pressure oil in the oil groove (55) to the low-pressure recess (71) in the area in which the overturning moment acting on said orbiting scroll (26) due to gas compression becomes the certain value or more can reduce the pressing-back force. Thus, it can make the revolution of the orbiting scroll (26) stable and also prevent a decrease of the operating efficiency.

Further, according to the thirteenth aspect of the present invention, providing the notch, as the low-pressure recess (71), formed at the fixed scroll (22) or the orbiting scroll (26) so as to connect with the space having the lower pressure than that of the inside of the oil groove (55) can materialize the movement of the invention defined in the twelfth aspect with a simple structure.

BEST MODE FOR CARRYING OUT THE INVENTION

First Embodiment

The first embodiment of the present invention will be described with reference to the accompanying drawings. A scroll-type compressor (1) according to the first embodiment compresses a gas refrigerant, being connected to a refrigerating circuit, not shown in any drawing, which performs a refrigerating-cycle operation with a refrigerant circulated therein.

Figure 1:
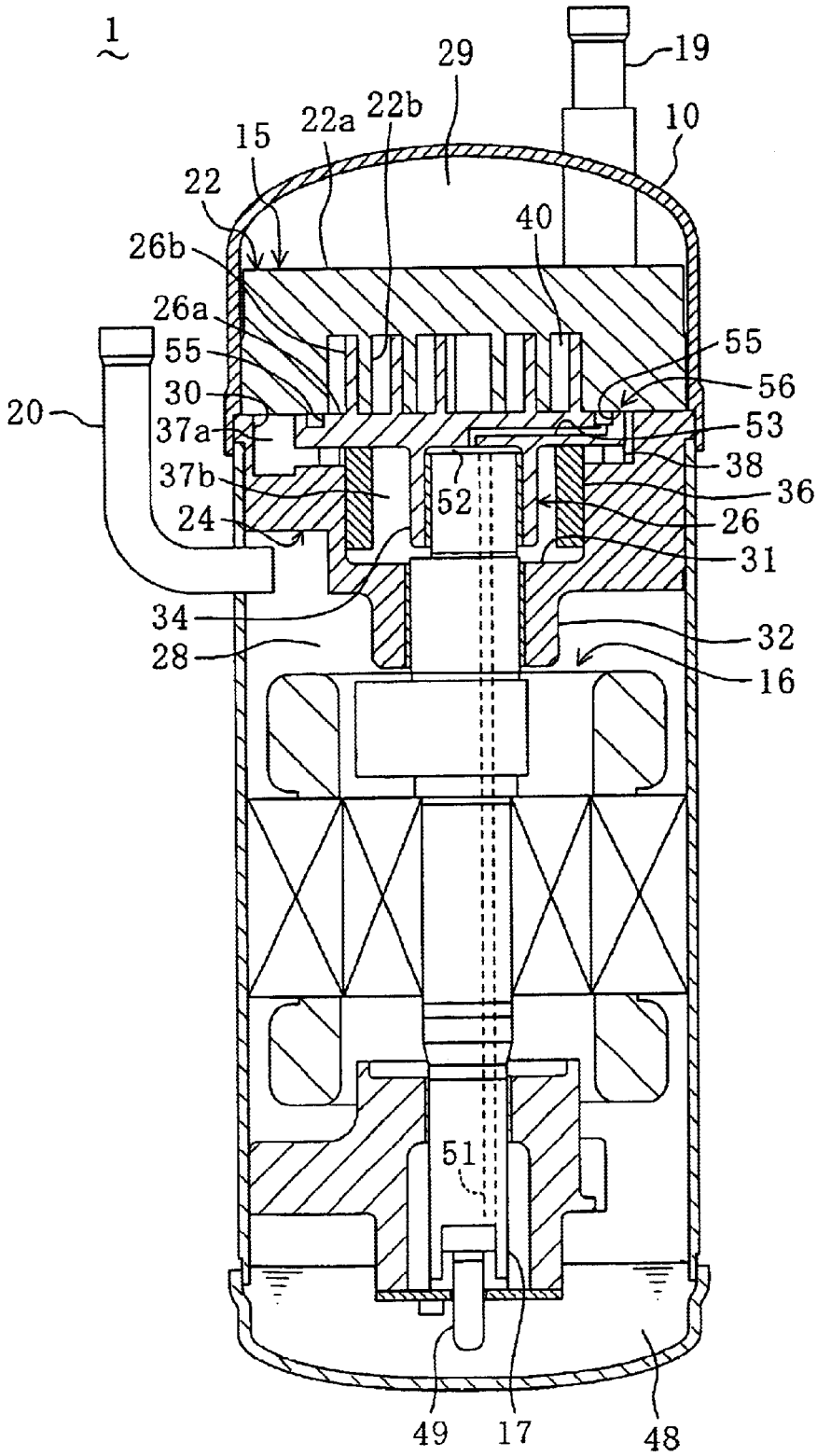
FIG. 1 is a sectional view showing an entire structure of a scroll-type compressor according to the first embodiment of the present invention.

As shown in FIG. 1, the scroll-type compressor (1) includes a casing (10) constituted of a sealed dome-type pressure vessel. In the casing (10), a compressing mechanism (15) to compress the gas refrigerant and a compressor motor (16) to drive the compressing mechanism (15) are installed. The compressor motor (16) is disposed below the compressing mechanism (15). The compressing mechanism (15) and the compressor motor (16) are coupled by a drive shaft (17).

The compressing mechanism (15) includes a fixed scroll (22), a frame (24) disposed so as to contact to the lower face of the fixed scroll (22) closely, and an orbiting scroll (26) engaged with the fixed scroll (22). The frame (24) has an airtight connection with the casing (10) at its entire periphery. The casing (10) has also divided sections therein, a high-pressure space (28) disposed below the frame (24) and a low-pressure space (29) disposed above the frame (24). The frame (24) is provided with a frame recess (30) formed at the upper face thereof, a center recess (31) formed at the bottom face of the frame recess (30), and a bearing portion (32) disposed at the center of the lower face of the frame (24) to constitute an upper bearing portion. The bearing portion (32) supports the drive shaft (17) through slide bearings so that the drive shaft (17) can rotate freely therein.

A suction pipe (19) to introduce the refrigerant of the refrigerating circuit into the compressing mechanism (15) and a discharge pipe (20) to discharge the refrigerant in the casing (10) out of the casing (10) casing (10) are coupled to the casing (10) respectively with airtight connections.

The fixed scroll (22) and the orbiting scroll (26) include respectively end plates (22*a*,26*a*) and involute wraps (22*b*, 26*b*). At the lower face of the end plate (26*a*) of the orbiting scroll (26), a bearing portion (34) that is located inside the frame recess (30) and the center recess (31) and coupled to the drive shaft (17) is provided. A ring-shape seal member (36) is disposed outside the bearing portion (34) so as to fit into the inner peripheral face of the center recess (31). The inside of the frame recess (30) and the center recess (31) is divided into the first space (37*a*) disposed outside the seal member (36) and the second space (37*b*) disposed inside the seal member (36), by the seal member (36) that is pressed and contacted closely to the end plate (26*a*) of the orbiting scroll (26) by spring means (not shown in any drawing), such as a plate spring. The frame (24) is provided with an oil-return hole (not shown in any drawing) to drain refrigerating machine oil collected in the second space (37*b*) to the lower part of the frame (24), and the second space (37*b*) is connected to the lower space of the frame (24).

The upper end of the drive shaft (17) is inserted in the bearing portion (34) of the orbiting scroll (26). Meanwhile, the orbiting scroll (26) is coupled to the frame (24) through an Oldham ring (38) so as to orbitally revolve in the frame (24) without rotating on its own axis. The lower face of the end plate (22*a*) of the fixed scroll (22) and the upper face of the end plate (26*a*) of the orbiting scroll (26) constitute sliding face for both faces contacting to and sliding on each other, and a gap between contacting portions of the wraps (22*b*,26*b*) of both scrolls (22,26) is formed as a compression chamber (40). Here, the compression chamber (40) is contracted toward the center by the revolution of the orbiting scroll (26), thereby compressing the gas refrigerant. The gas refrigerant compressed in the compression chamber (40) is discharged below the frame (24) through a discharge passage, not shown in any drawing. Thus, the space below the frame (24) constitutes the high-pressure space (28).

The casing (10) is provided with an oil reservoir (48) at the bottom, and an oil supply pump (49) is disposed at the lower end of the drive shaft (17) to pump up the oil in the oil reservoir (48) by the rotation of the drive shaft (17).

A drive-shaft oil-supply passage (51), in which the oil pumped up by the oil supply pump (49) flows, is formed at the drive shaft (17). Further, an oil chamber (52) is formed between the drive shaft (17) and the end plate (26*a*) in the bearing portion (34) of the orbiting scroll (26), and the oil flowing into the drive-shaft oil-supply passage (51) is discharged to the oil chamber (52) and respective oil-supplied portions.

As described above, the refrigerating machine oil with high pressure is supplied to the oil chamber (52) in the bearing portion (34) of the orbiting scroll (26), and further the second space (37*b*) is filled with the gas refrigerant with high pressure. In the above-described structure, pressing means (37*b*, 52) to press the orbiting scroll (26) to the fixed scroll in the axis direction by making use of pressure of the refrigerating machine oil and the gas refrigerant is constituted. Also, the sliding face is constituted as a thrust bearing by pressing the end plates (22*a*,26*a*) of the both scrolls (22,26) to each other.

Meanwhile, an oil-introduction passage (53) extending in the radius direction is formed at the end plate (26*a*) of the orbiting scroll (26). The oil-introduction passage (53) is connected to the oil chamber (52) at its inner end, and to the oil groove (55) disposed at the upper face of the end plate (26*a*) at its outer end. The refrigerating machine oil is supplied from the oil chamber (52) to the above-described sliding face through the oil-introduction passage (53). It is constituted that supplying the refrigerating machine oil to the sliding face reduces a machine loss of the thrust bearing.

Figure 2:
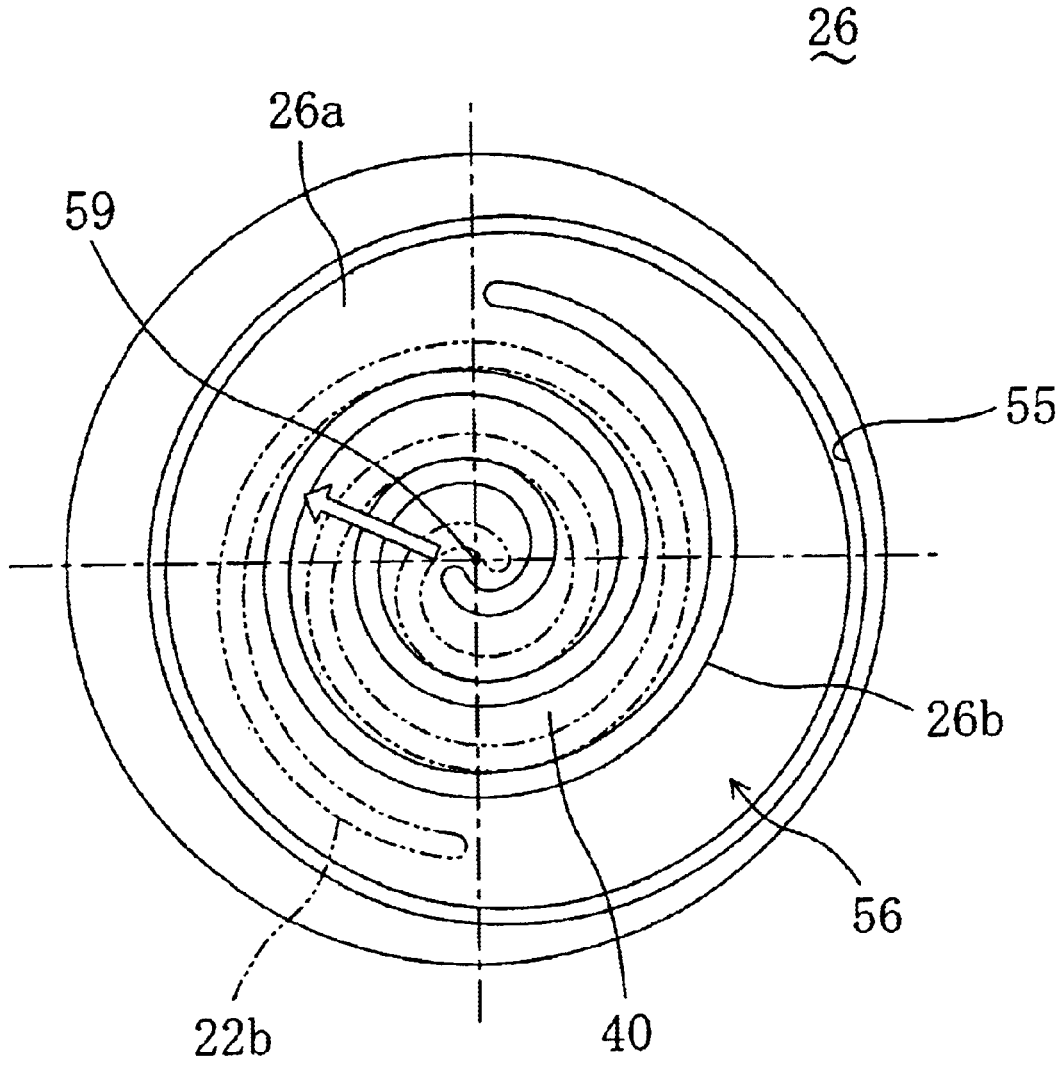
FIG. 2 is a plan view of an orbiting scroll in the first embodiment.

Further, the oil groove (55) constitutes adjusting means (56) to adjust the pressing force of the orbiting scroll (26)

against the fixed scroll (22) along with the oil-introduction passage (53). The oil groove (55) is formed at the end plate (26*a*) of the orbiting scroll (26), and it is formed at the outer peripheral side of the wrap (26*b*) in a circumferential ring shape, as shown in FIG. 2. The oil groove (55) is formed with its center that is offset from the center of the wrap (26*b*) of the orbiting scroll (26). Specifically, the oil groove (55) is constituted such that an anti-overturning moment to reduce an overturning moment acts in substantially the opposite direction to the acting direction of the overturning moment (see an arrow mark in FIG. 2) in a revolving-angle area in which the overturning moment acting on the orbiting scroll (26) is more than a certain value during its revolution. Accordingly, the oil groove (55) is constituted such that an acting point of the high pressure to the orbiting scroll (26) is offset from the center of the orbiting scroll (26) toward the opposite acting side of the overturning moment. Thus, the oil groove (55) is positioned so that the portion of the acting side of the overturning moment is located close to the center of the orbiting scroll, whereas the portion of the opposite acting side is located far from the center.

Herein, the acting direction of the overturning moment is determined depending on the following conditions. That is, the orbiting scroll (26) receives the axis-direction gas load and the radius-direction load that is a resultant force by a gas force in the direction along the sliding face of the both end plates (22*a*,26*a*) and a centrifugal force, due to the pressure of the gas refrigerant in the compression chamber (40), and these loads become the maximum at a certain crank angle (revolving-angle area of orbiting scroll (26)). Because the overturning moment occurs in substantially the acting direction of the radius-direction load at this time, this direction may be determined as the one in which the overturning moment acts.

In this way, providing the oil groove (55) that is positioned offset from the center of the orbiting scroll (26) can make certainly the pressing-back force for the orbiting scroll (26) against the pressing force, whose acting point is offset from the center of the orbiting scroll.

Then, in a revolving-angle area in which the pressure of the compression chamber increases and the overturning moment becomes a certain value or more, the overturning moment is reduced by the anti-overturning moment. Meanwhile, in a revolving-angle area in which the pressure of the compression chamber is low and the overturning moment is smaller than the certain value, the magnitude of the anti-overturning moment should be determined depending on the relationship with the pressing force so that the anti-overturning moment does not become an overturning moment with the opposite direction. This can prevent the orbiting scroll (26) from overturning even if the overturning moment is so great that the orbiting scroll (26) would be easy to overturn, and also the problem that when the overturning moment is small the anti-overturning moment would act as an overturning moment with the opposite direction can be prevented.

As a result, it may become possible that the orbiting scroll (26) is pressed against the fixed scroll (22) all the time with a stable force, thereby achieving a stable revolution of the orbiting scroll. Accordingly; it can prevent the orbiting scroll (26) from overturning efficiently and certainly, thereby improving the compression efficiency certainly.

Further, in the first embodiment, just offsetting the oil groove from the center of the orbiting scroll can make the movement of the orbiting scroll stable, so that complicated structure can be avoided.

Second Embodiment

Figure 3:
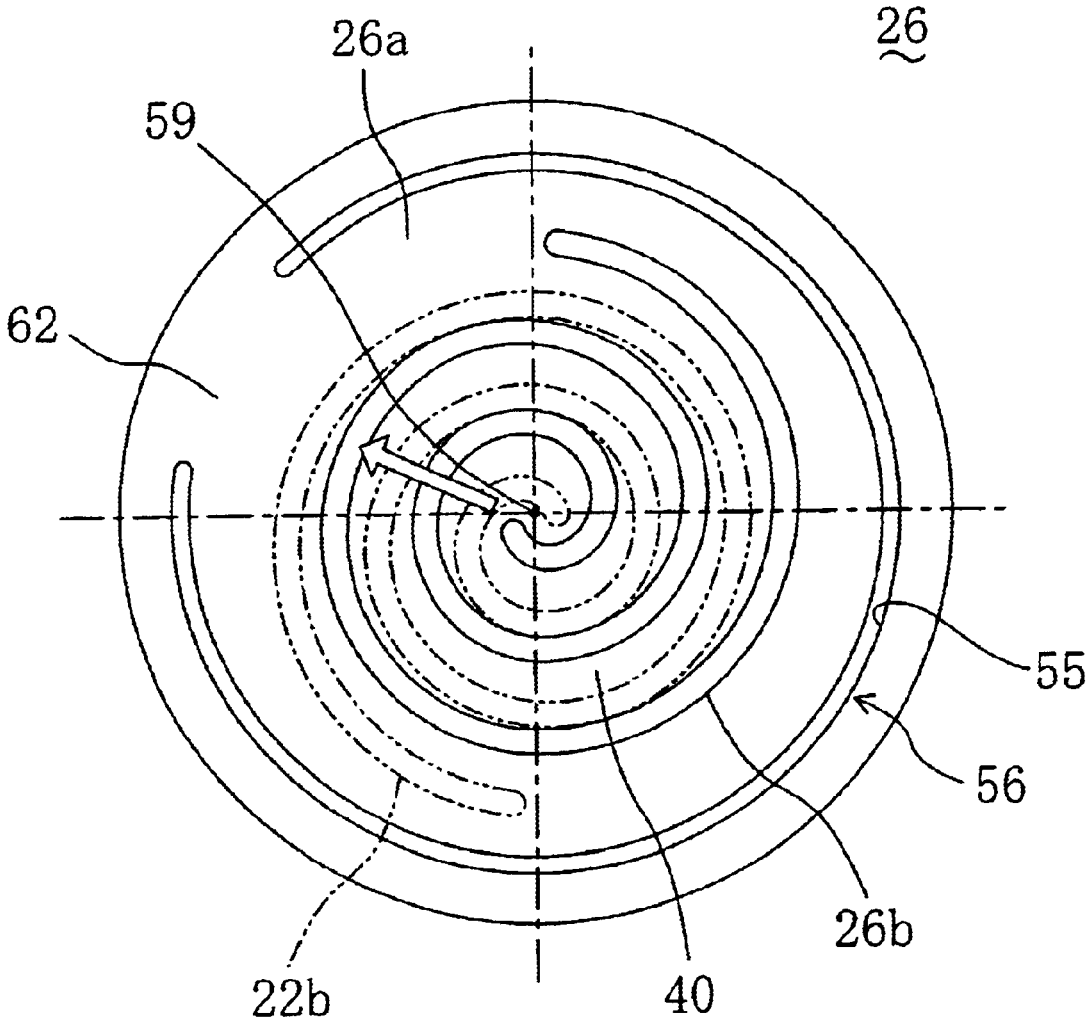
FIG. 3 is a plan view of an orbiting scroll in the second embodiment.

The scroll-type compressor (1) according to the second embodiment includes a different adjusting mechanism (56) from that in the first embodiment. Specifically, as shown in FIG. 3, the adjusting mechanism (56) has an oil groove (55) with a different shape from that in the first embodiment. The oil groove (55) is formed in a circumferential ring shape with its center concentric to the center of the wrap (26*b*) of the orbiting scroll (26), and formed in such manner that a portion (62) thereof at the acting side of the overturning moment to the center of the orbiting scroll (26) is disconnected. Thus, the oil groove (55) has almost a C-shape plan view.

Further, the oil groove (55) is formed in an arc shape with a constant width. A portion of the groove (55), in which no groove is formed at the portion (62) at the acting side of the overturning moment, is disposed at a side where the overturning moment acts to the center of the orbiting scroll (26) in the revolving-angle area in which the overturning moment acting on the orbiting scroll (26) becomes the certain value or more.

Herein, descriptions on the same components as those in the first embodiment will be omitted, getting them the same reference numerals.

In the second embodiment, the oil groove (55) having its C-shape plan view can certainly offset the acting point of the pressing-back force which the orbiting scroll (26) receives due to supplying the refrigerating machine oil to the oil groove (55) at the sliding face, from the center of the orbiting scroll (26).

Further, because the disconnected portion (62) of the oil groove (55) is disposed at the acting side of the overturning moment in the above revolving-angle area to the center (59) of the orbiting scroll (26), the pressing-back force by the high pressure of the refrigerating machine oil can be made small at the acting side of the overturning moment, and great at its opposite side. As a result, the anti-overturning moment to reduce the above overturning moment acts in the opposite direction to the overturning moment. Thus, it can prevent the orbiting scroll (26) from overturning efficiently and certainly, thereby improving the compression efficiency certainly.

Other functions and effects are the same as those in the first embodiment.

Herein, in the second embodiment, the portion (62) of the oil groove (55) is disconnected at the acting side of the overturning moment, but instead of that, the portion may be made narrow and the like, thereby providing a small groove area. This can also perform functions and effects similar to the above because of the occurrence of the anti-overturning moment to reduce the overturning moment.

Third Embodiment

Figure 4:
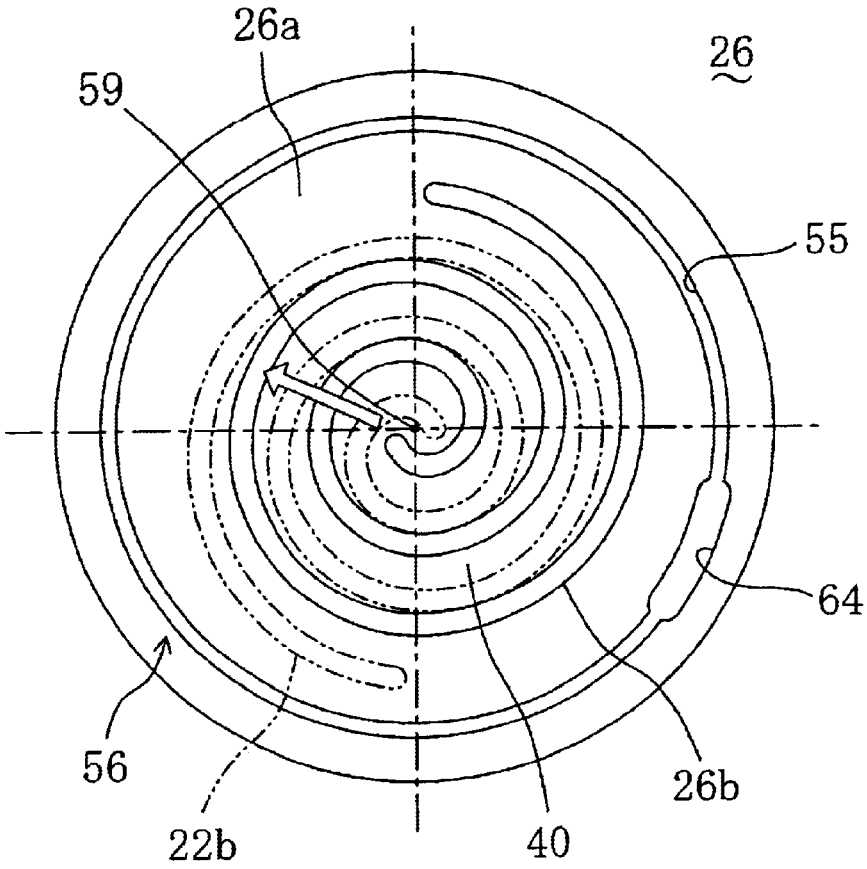
FIG. 4 is a plan view of an orbiting scroll in the third embodiment.

The scroll-type compressor (1) according to the third embodiment includes a different adjusting mechanism (56) from those in the first and second embodiments. Specifically, as shown in FIG. 4, the adjusting mechanism (56) has an oil groove (55) with a different shape from those in the first and second embodiments.

The oil groove (55) is formed at the sliding face of the orbiting scroll (26) so as to be concentric to the center (59) of the orbiting scroll (26). The oil groove (55) is formed in a circumferential ring shape and provided with a widened portion (64) with an enlarged width at part of its periphery. The widened portion (64) is positioned at the opposite side to the acting side of the overturning moment to the center of the orbiting scroll (26) in a revolving-angle area in which the overturning moment acting on the orbiting scroll (26) becomes a certain value or more.

Because the widened portion (64) is formed at the circumferential ring-shape oil groove (55) supplying an oil to the sliding face, the acting point of the pressing-back force which the orbiting scroll (26) receives due to high-level pressure of the refrigerating machine oil at the sliding face can be certainly offset from the center of the orbiting scroll (26).

Further, because the widened portion (64) of the oil groove (55) is formed at the opposite side to the acting side of the overturning moment to the center (59) of the orbiting scroll (26) in the above revolving-angle area, the pressing-back force at the acting side of the overturning moment differs from the one at the opposite acting side of the overturning moment to the center of the orbiting scroll (26), and thereby anti-overturning moment with the opposite direction to the overturning moment occurs. Accordingly, the overturning moment can be reduced when the overturning moment becomes the certain value or more, and thus the orbiting scroll (26) can be prevented from overturning efficiently and certainly, thereby improving the compression efficiency of the compressor certainly.

Other structures, functions and effects are the same as those in the first embodiment.

Fourth Embodiment

Figure 5:
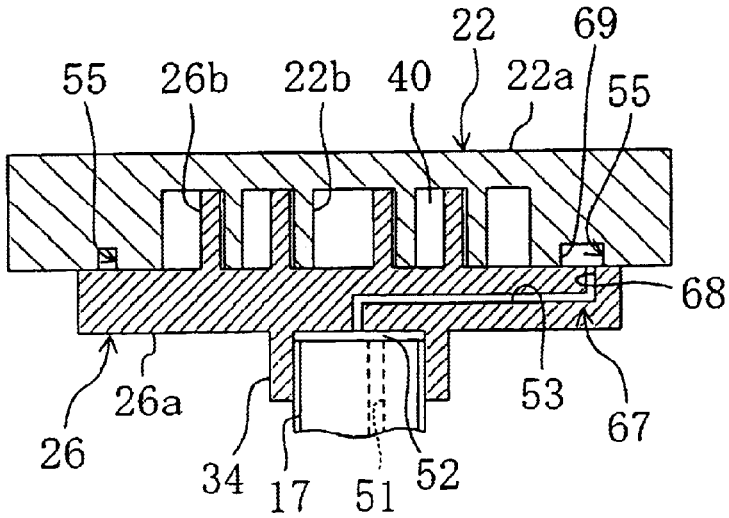
FIG. 5 is a sectional view of a fixed scroll and an orbiting scroll in the fourth embodiment.
Figure 6:
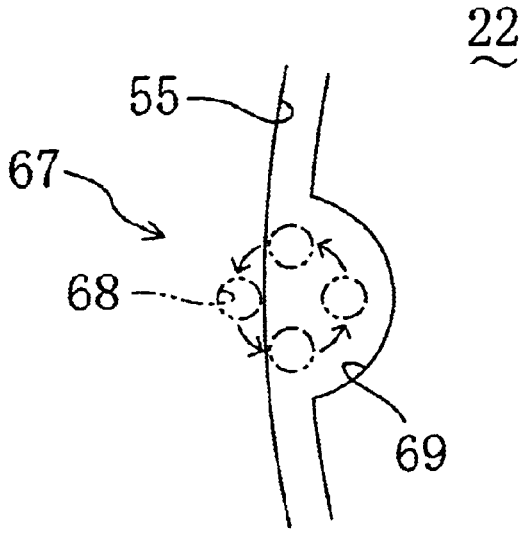
FIG. 6 is a view showing positional relationship between an oil groove and an opening of an oil-induction passage in the fourth embodiment.
Figure 7:
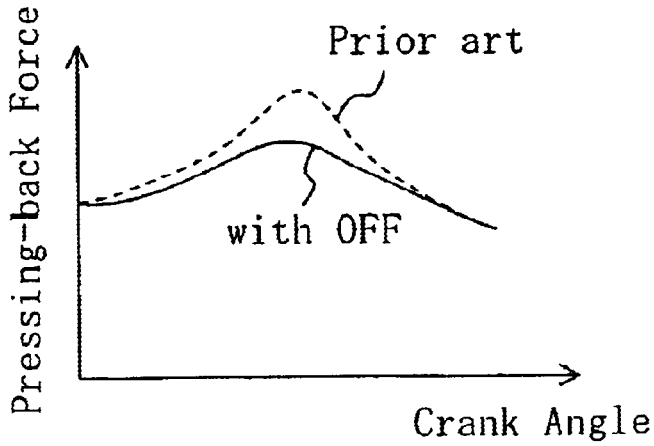
FIG. 7 is a characteristic diagram showing fluctuation of a pressing-back force of the orbiting scroll by a gas refrigerant in the fourth embodiment.

The scroll-type compressor (1) according to the fourth embodiment, shown in FIGS. 5 through 7, includes a different adjusting mechanism (67) from those in the first through third embodiments. The adjusting mechanism (67) in the fourth embodiment is constituted such that it produces the pressing-back force to press back the orbiting scroll (26) from the fixed scroll (22) against the pressing force by the pressing means (37*b*,52), while it cuts off the pressing-back force in the revolving-angle area in which the overturning moment acting on the orbiting scroll (26) due to gas compression of the gas refrigerant becomes the certain value or more.

The adjusting mechanism (67) comprises the oil groove (55) that is formed at the sliding face constituted between the fixed scroll (22) and the orbiting scroll (26), and the oil-introduction passage (53) that can be connected to the oil groove (55) so as to introduce high-pressure oil into the oil groove (55). The oil groove (55) is formed at the fixed scroll (22) in a circumferential ring shape, and the oil-introduction passage (53) is formed at the orbiting scroll (26). A state of connection or non-connection between an opening (68) of outer end of the oil-introduction passage (53) and the oil groove (55) is switched depending on revolving angle of the orbiting scroll (26). Namely, the connection state between the oil groove (55) and the oil-introduction passage (53) is changed during the revolution of the orbiting scroll (26).

Specifically, the above connection is cut off in the revolving-angle area in which the overturning moment acting on the orbiting scroll (26) due to the compression of the gas refrigerant becomes the certain value or more, while the connection is maintained in other area. In this way, because the present embodiment is constructed to switch the state of connection or non-connection between the oil groove (55) and the oil-introduction passage (53), it is necessary that the opening (68) and the oil groove (55) are formed at the both scrolls (22,26) respectively.

An enlarged portion (69), whose inner periphery projects inwardly, is formed at the oil groove (55) as shown in FIG. 6. The enlarged portion (69) is constituted of an arc with a somewhat larger radius of curvature than a revolving radius of the orbiting scroll (26).

The opening (68) of the oil-introduction passage (53) is disposed at a position where it has a repeated state of connection or non-connection with the enlarged portion (69) of the oil groove (55) at the fixed scroll (22). The opening (68) is constituted in such manner that it orbitally revolves at the enlarged portion (69) of the oil groove (55) according to the revolution of the orbiting scroll (26) and its connection is cut off (OFF) at its certain position during the revolution of the orbiting scroll (26) where the opening (68) is located outside the enlarged portion (69). The positional relationship between the above-described opening (68) and the enlarged portion (69) of the oil groove (55) is constituted in such manner that the connection is cut off and the occurrence of the pressing-back force by the high-pressure oil stops, in a revolving-angle area in which the overturning moment acting on the orbiting scroll (26) due to the compression of the gas refrigerant during the revolution of the orbiting scroll (26) becomes a certain value or more, thereby producing almost a maximum of power to separate the both scrolls (22,26) from each other. That is, the above revolving-angle area is the one in which the pressing force of the orbiting scroll (26) to the fixed scroll (22) is kept relatively great in order not to overturn the orbiting scroll (26), and the pressing-back force by the discharge of oil is reduced at this point, as shown in FIG. 7.

According to the scroll-type compressor (1) in the fourth embodiment, the connection state between the oil groove (55) and the oil-introduction passage (53) is cut off at the certain position during the revolution. Thus, stopping temporarily supplying the oil to the sliding face during the revolution can reduce certainly the pressing-back force acting on the orbiting scroll (26) by the high-pressure oil at the above certain position.

Also, the pressing-back force by the high-pressure oil is reduced in the revolving-angle area in which the overturning moment produced by the compression of the gas refrigerant becomes almost the maximum. Therefore, the resultant force by the axis-direction gas load, the pressing-back force, and the pressing force of the pressing means (37*b*,52) can be made great. Namely, it can maintain the pressing force of the orbiting scroll (26) against the fixed scroll (22) at a certain value or more. As a result, it becomes possible to press firmly the orbiting scroll (26) against the fixed scroll (22) all the time, and thereby the compression efficiency can be improved certainly by suppressing the overturning of the orbiting scroll (26) certainly.

Other structures, functions and effects are the same as those in the first embodiment.

Fifth Embodiment

Figure 8:
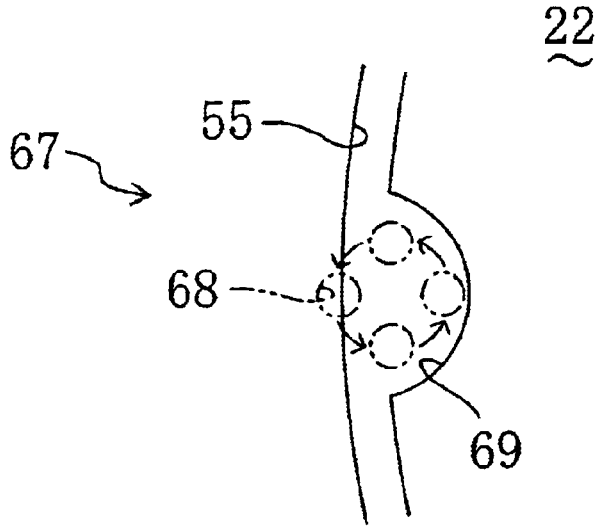
FIG. 8 is a view showing positional relationship between an oil groove and an opening of an oil-induction passage in the fifth embodiment.

The scroll-type compressor (1) according to the fifth embodiment is different from the fourth embodiment in the structure of changing the connection state between the oil groove (55) and the oil-introduction passage (53) during the revolution of the orbiting scroll (26). As shown in FIG. 8, it is constituted such that the connection area between the opening (68) of the oil-introduction passage (53) and the oil groove (55) is reduced at a certain position during the revolution.

That is, in the forth embodiment, it is constituted such that the connection between the opening (68) and the oil groove (55) is cut off in the revolving-angle area in which the overturning moment by the compression of the gas refrigerant increases and thereby the minimum of necessary pressing force of the orbiting scroll (26) becomes great. Meanwhile, in the fifth embodiment, the connection between the opening (68) and the oil groove (55) is maintained but the area of that connection is reduced in this revolving-angle area, instead of cutting off the connection fully.

Accordingly, because it can be suppressed in this case that the resultant force by the axis-direction gas load by the gas refrigerant and the pressing force by the high-pressure oil becomes too great, the pressing force of the orbiting scroll (26) can be maintained at a certain value or more. Thus, it can improve the compression efficiency certainly by suppressing the overturning of the orbiting scroll (26) certainly.

Other structures, functions and effects are the same as those in the fourth embodiment.

Sixth Embodiment

In the scroll-type compressor (1) according to the sixth embodiment, it is constituted, unlike the fourth and fifth embodiments, such that part of the high-pressure oil in the oil groove (55) is released to a space at the low-pressure side in the casing (10) in the revolving-angle area in which the overturning moment acting on the orbiting scroll (26) due to the compression of the gas refrigerant during the revolution of the orbiting scroll (26) becomes the certain value or more.

Figure 9:
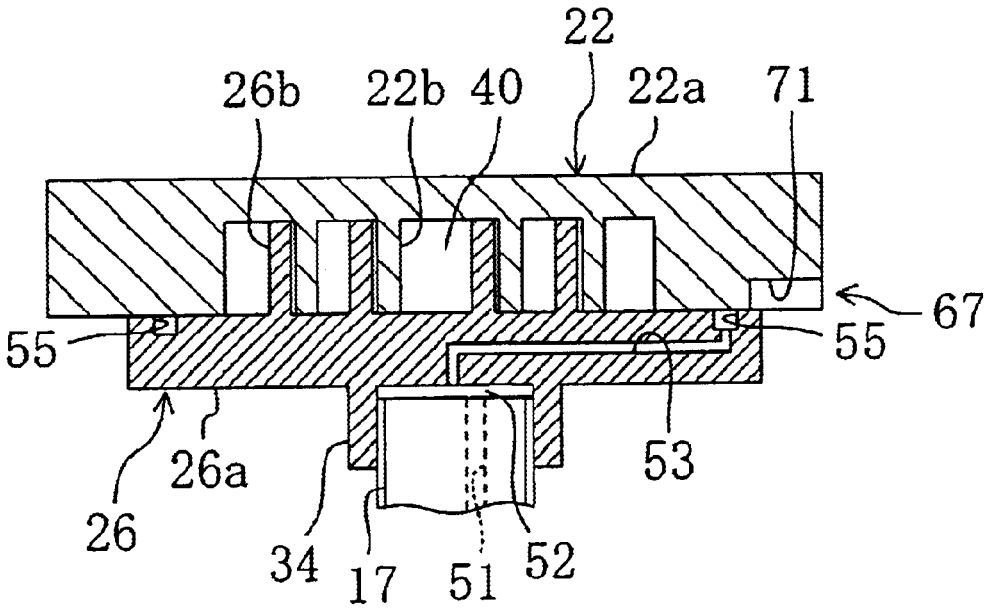
FIG. 9 is a sectional view of a fixed scroll and an orbiting scroll in the sixth embodiment.
Figure 10:
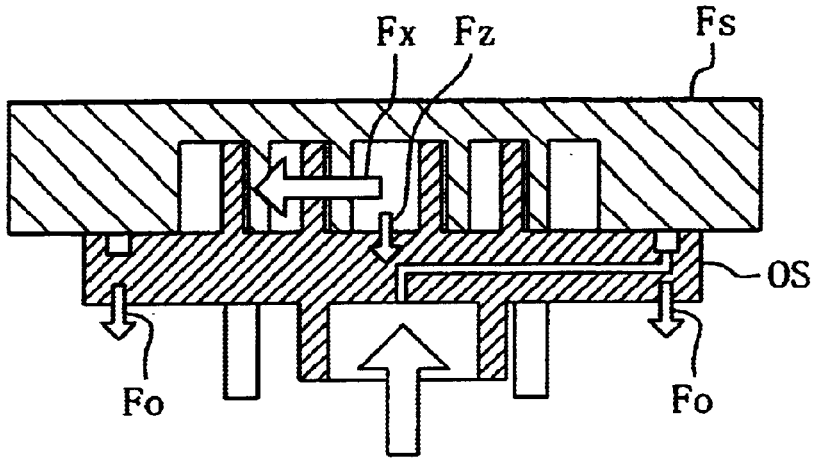
FIG. 10 is a view showing force acting on an orbiting scroll in a conventional scroll-type compressor.
Figure 11:
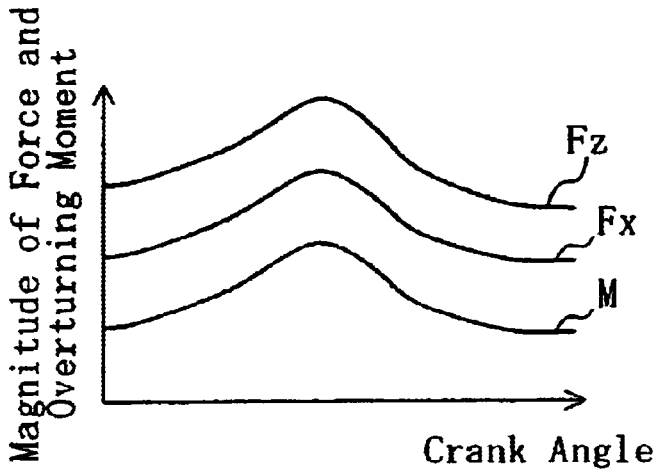
(Prior Art) FIG. 11
FIG. 11 is a characteristic diagram showing fluctuation of force acting on the orbiting scroll and an overturning moment in the conventional scroll-type compressor.

As shown in FIG. 9, an adjusting mechanism (67) comprises the oil groove (55) that is formed at the sliding face constituted between the fixed scroll (22) and the orbiting scroll (26), and the oil-introduction passage (53) that is connected to the oil groove (55) so as to introduce high-pressure oil into the oil groove (55). The oil groove (55) and the oil-introduction passage (53) are formed at the orbiting scroll (26). Further, a low-pressure recess (71) that the oil groove (55) approaches in the revolving-angle area in which the overturning moment acting on the orbiting scroll (26) due to the compression of the gas refrigerant becomes the certain value or more is formed at the fixed scroll (22).

The low-pressure recess (71) is constituted of a notch that is formed at the peripheral edge portion at the sliding face which contacts the orbiting scroll (26). This notch (71) is constituted such that it connects with the first space (37*a*) having a lower pressure than the inside of the oil groove (55). Also, it is constituted such that the notch (71) approaches the oil groove (55) the closest in the revolving-angle area in which the minimum of the pressing force necessary for the orbiting scroll (26) due to the gas refrigerant during the revolution of the orbiting scroll (22) becomes great. Thus, when the oil groove (55) of the orbiting scroll (26) approaches the notch (71) of the fixed scroll (22) and thereby the sliding area between the oil groove (55) and the notch (71) becomes small, part of the high-pressure oil in the oil groove (55) leaks into the notch (71) with a lower pressure.

Accordingly, because the pressing-back force that the orbiting scroll (26) receives from the oil at the sliding face in the above revolving-angle area can be reduced certainly, it can be prevented that the resultant force by this pressing-back force and the axis-direction force by the refrigerant compression becomes too great at this point. Thus, the pressing force of the orbiting scroll (26) against the fixed scroll (22) can be maintained at the certain value or more and thereby the overturning of the orbiting scroll (26) can be suppressed certainly, resulting in improving the compression efficiency certainly.

Other structures, functions and effects are the same as those in the fourth and fifth embodiments.

Other Embodiments

The above embodiments make use of the high pressure of the refrigerating machine oil to produce the pressing-back force of the orbiting scroll (26), but other means such as the high pressure of the gas refrigerant may be applied.

Further, in the above embodiments, letting the high-pressure oil in the oil chamber (52) and the high-pressure gas refrigerant in the second space (37*b*) act on the orbiting scroll (26) constitutes means for pressing the orbiting scroll (26) against the fixed scroll (22). The pressing means, however, is not limited to this structure, but any other proper means can be applied.

Further, it is constituted such that the anti-overturning moment is produced in the first through third embodiments and the pressing-back force of the high-pressure oil fluctuates in the fourth through sixth embodiments. However, it can be constituted such that these two are applied at the same time.

Further, although it is constituted such that the oil groove (55) is formed at the orbiting scroll (26) in the first through third embodiments, the oil groove (55) may be formed at the fixed scroll (22) instead. In this case, the oil-introduction passage (53) is formed in such manner, for example, that it goes through the inside of the fixed scroll (22) from the frame (24). In the event that the oil groove (55) is formed at the fixed scroll in the first embodiment, it may be preferably constituted such that the center of the oil groove (55) is offset from the center of the orbiting scroll (26) located in the revolving-angle area in which the overturning moment of the orbiting scroll (26) becomes more than the certain value. Further, in the event that the oil groove (55) is formed at the fixed scroll in the second and third embodiments, it may be constituted such that the center of the oil groove (55) coincides with, for example, the center of the fixed scroll (22).

Further, although it is constituted such that the oil groove (55) is formed at the fixed scroll (22) and the oil-introduction passage (53) is formed at the orbiting scroll (26) respectively in the fourth and fifth embodiments, it may be constituted such that the oil groove (55) is formed at the orbiting scroll (26) and the oil-introduction passage (53) is formed at the fixed scroll (22) respectively instead. In short, it should be constituted such that, during the revolution of the orbiting scroll (26), the connection between the oil-introduction passage (53) and the oil groove (55) is cut off temporarily, or the connection area between them is reduced.

Further, although it is constituted such that the notch (71) is formed at the fixed scroll (22), it may be constituted such that oil groove (55) is formed at the fixed scroll (22) and the notch (71) is formed at the orbiting scroll (26) instead. In short, it should be constituted such that the notch (71) and the oil groove (55) approach each other or are away from each other during the revolution of the orbiting scroll (26).

INDUSTRIAL APPLICABILITY

As described above, the present invention is useful for the scroll-type compressor.

What is claimed is:

1. A scroll-type compressor comprising:

a fixed scroll that is fixed in a casing;

an orbiting scroll that engages with said fixed scroll;

a pressing part that presses said orbiting scroll against said fixed scroll in an axial direction; and an adjusting mechanism that adjusts a pressing force of said orbiting scroll against said fixed scroll, said adjusting mechanism being configured and arranged such that an anti-overturning moment to decrease an overturning moment acting on said orbiting scroll during revolution of said orbiting scroll is produced in a revolving-angle area of said orbiting scroll in which said overturning moment becomes at least a predetermined value.

2. The scroll-type compressor of claim 1, wherein said adjusting mechanism is configured and arranged such that said anti-overturning moment acts in substantially an opposite direction to said overturning moment in said revolving-angle area of said orbiting scroll.

3. The scroll-type compressor of claim 2, wherein said adjusting mechanism comprises an oil groove that is formed at a sliding face constituted between said fixed scroll and said orbiting scroll, and an oil-introduction passage that introduces a high-pressure oil into said oil groove, and said oil groove is configured and arranged such that an acting point of a high pressure to said orbiting scroll is offset from a center of said orbiting scroll located in said revolving-angle area.

4. The scroll-type compressor of claim 3, wherein said oil groove is formed in a circumferential ring shape and formed at one of said fixed scroll and said orbiting scroll in such a manner that a center of said oil groove is offset from said center of said orbiting scroll.

5. The scroll-type compressor of claim 3, wherein said oil groove is configured and arranged such that an oil-pressure acting area at an acting side of said overturning moment is smaller than an oil-pressure acting area at an opposite acting side of said overturning moment relative to said center of said orbiting scroll.

6. The scroll-type compressor of claim 5, wherein said oil groove is formed in a circumferential ring shape with a center of said oil groove being concentric to said orbiting scroll, and formed in such a manner that a portion thereof is disconnected at said acting side of said overturning moment.

7. The scroll-type compressor of claim 5, wherein said oil groove is formed in a circumferential ring shape with a center of said oil groove being concentric to said orbiting scroll, and comprises a widened portion with an enlarged width at said opposite acting side of said overturning moment.

8. The scroll-type compressor of claim 1, wherein said adjusting mechanism comprises an oil groove that is formed at a sliding face constituted between said fixed scroll and said orbiting scroll, and an oil-introduction passage that introduces a high-pressure oil into said oil groove, and said oil groove configured and arranged such that an acting point of a high pressure to said orbiting scroll is offset from a center of said orbiting scroll located in said revolving-angle area.

9. The scroll-type compressor of claim 8, wherein said oil groove is formed in a circumferential ring shape and formed at one of said fixed scroll and said orbiting scroll in such a manner that a center of said oil groove is offset from said center of said orbiting scroll.

10. The scroll-type compressor of claim 8, wherein said oil groove is configured and arranged such that an oil-pressure acting area at an acting side of said overturning moment is smaller an oil-pressure acting area at an opposite acting side of said overturning moment relative to said center of said orbiting scroll.

11. The scroll-type compressor of claim 10, wherein said oil groove is formed in a circumferential ring shape with a center of said oil groove being concentric to said orbiting scroll, and formed in such a manner that a portion thereof is disconnected at said acting side of said overturning moment.

12. The scroll-type compressor of claim 10, wherein said oil groove is formed in a circumferential ring shape with a center of said oil groove being concentric to said orbiting scroll, and comprises a widened portion with an enlarged width at said opposite acting side of said overturning moment.

13. A scroll-type compressor comprising:

a fixed scroll that is fixed in a casing;

an orbiting scroll that engages with said fixed scroll;

a pressing part that presses said orbiting scroll against said fixed scroll in an axial direction; and an adjusting mechanism that adjusts a pressing force of said orbiting scroll against said fixed scroll, said adjusting mechanism being configured and arranged to produce a pressing-back force to press back said orbiting scroll from said fixed scroll against said pressing force, while said adjusting mechanism cuts off said pressing-back force in a revolving-angle area of said orbiting scroll in which an overturning moment acting on said orbiting scroll during revolution of said orbiting scroll due to gas compression becomes at least a predetermined value.

14. The scroll-type compressor of claim 13, wherein said adjusting mechanism comprises an oil groove that is formed at a sliding face constituted between said fixed scroll and said orbiting scroll, and an oil-introduction passage that is configured to be connected to said oil groove so as to introduce a high-pressure oil into said oil groove, and said oil groove and said oil-introduction passage are configured and arranged such that connection of said oil groove and said oil-introduction passage can be cut off in said revolving-angle area of said orbiting scroll.

15. A scroll-type compressor comprising:

a fixed scroll that is fixed in a casing;

an orbiting scroll that engages with said fixed scroll;

a pressing part that presses said orbiting scroll against the said fixed scroll in an axial direction; and an adjusting mechanism that adjusts a pressing force of said orbiting scroll against said fixed scroll, said adjusting mechanism being configured and arranged to produce a pressing-back force to press back said orbiting scroll from said fixed scroll against said pressing force, while said adjusting mechanism reduces said pressing-back force in a revolving-angle area of said orbiting scroll in which an overturning moment acting on said orbiting scroll during revolution of said orbiting scroll due to gas compression becomes at least a predetermined value.

16. The scroll-type compressor of claim 15, wherein said adjusting mechanism comprises an oil groove that is formed at a sliding face constituted between said fixed scroll and said orbiting scroll, and an oil-introduction passage that is connected to said oil groove so as to introduce a high-pressure oil into said oil groove, and said oil groove and said oil-introduction passage are configured such that an area of connection of said oil groove and said oil-introduction passage can be reduced in said revolving-angle area of said orbiting scroll.

17. The scroll-type compressor of claim 15, wherein said adjusting mechanism comprises an oil groove that is formed at a sliding face constituted between said fixed scroll and said orbiting scroll, and an oil-introduction passage that is connected to said oil groove so as to introduce a high-pressure oil into said oil groove;

said oil groove is formed at one of said fixed scroll and said orbiting scroll; and a low-pressure recess that said oil groove approaches in said revolving-angle area of said orbiting scroll is formed at the other one of said fixed scroll and said orbiting scroll.

18. The scroll-type compressor of claim 17, wherein said low-pressure recess is a notch that is formed at the other one of said fixed scroll and said orbiting scroll so as to connect with a space having a lower pressure than an inside of said oil groove.

* * * * *